US006525282B2

(12) United States Patent
Krebs et al.

(10) Patent No.: US 6,525,282 B2
(45) Date of Patent: Feb. 25, 2003

(54) PENDANT SWITCH ASSEMBLY FOR CONTROLLING A MOVABLE HOIST

(75) Inventors: Wolfgang Krebs, Wetter; Uwe Lichtenvort, Essen; Bernd Neupert; Klaus Weihmann, both of Wetter, all of (DE)

(73) Assignee: Atecs Mannesmann AG, Düsseldorf (DE)

( * ) Notice: Subject to any disclaimer, the term of this patent is extended or adjusted under 35 U.S.C. 154(b) by 127 days.

(21) Appl. No.: 09/804,579

(22) Filed: Mar. 12, 2001

(65) Prior Publication Data

US 2001/0025775 A1 Oct. 4, 2001

(51) Int. Cl.[7] ..... H01H 9/02
(52) U.S. Cl. ..... 200/298; 200/300
(58) Field of Search ..... 200/298, 293, 200/300; 248/317, 610

(56) References Cited

U.S. PATENT DOCUMENTS

| | | | | |
|---|---|---|---|---|
| 2,791,665 A | | 5/1957 | Baumbach | |
| 3,654,415 A | * | 4/1972 | Hawkins et al. | 200/157 |
| 4,520,247 A | * | 5/1985 | Pancook et al. | 200/298 |
| 5,541,579 A | * | 7/1996 | Kiernan | 340/573 |

FOREIGN PATENT DOCUMENTS

| | | | |
|---|---|---|---|
| DE | 2227364 | * | 7/1990 |
| EP | 509116 | * | 10/1992 |
| EP | 0 592 795 A1 | | 4/1994 |
| JP | 7-249349 | * | 9/1995 |

* cited by examiner

*Primary Examiner*—P. Austin Bradley
*Assistant Examiner*—Lisa N Klaus
(74) *Attorney, Agent, or Firm*—Henry M. Feiereisen

(57) ABSTRACT

A pendant switch assembly for controlling a hoist, includes a transmitter mounted to a housing for wireless transmission of control signals to a receiver mounted remotely with respect to the housing and operatively connected to a power controller of a drive of the hoist. A plurality of control elements is arranged in the housing and actuated by a plurality of actuators from outside for delivering control signals for the power controller to the transmitter. Secured to the hoist is a traction member which is guided downwards, with a receptacle secured to a lower end of the traction member. The housing is securely attachable to the receptacle by plugging in the housing into the receptacle, and detachable from the receptacle by withdrawal thereof. Electric energy is supplied to the control elements and the transmitter by a power source which is also accommodated in the housing.

10 Claims, 3 Drawing Sheets

PENDANT SWITCH ASSEMBLY FOR CONTROLLING A MOVABLE HOIST

CROSS-REFERENCES TO RELATED APPLICATIONS

This application claims the priority of German Patent Application Serial No. 100 14 904.9, filed Mar. 17, 2000, the subject matter of which is incorporated herein by reference.

BACKGROUND OF THE INVENTION

The present invention relates, in general, to a pendant switch assembly, and more particularly to a pendant switch assembly for controlling various operations of a hoist to raise and lower a load-carrying member mounted to a traction member.

U.S. Pat. No. 2,791,665 discloses a pendant switch assembly for operating an overhead crane. The pendant switch assembly includes a housing for accommodating control elements in the form of switches which are actuated by an operator from outside by buttons. In response to the actuation of a button, control signals are generated by which the overhead crane is moved. The housing is connected with the overhead crane by a cable. Running along the cable is a separate electric cable by which the control signals are conducted to the overhead crane.

European Pat. No. EP 592,795 discloses a pendant switch assembly which includes a housing for accommodating control elements which are actuated by push buttons. The housing has an upper end which is connected via an electric cable, provided with a central strain relief cable, to a hoist and its control mechanism. The upper housing portion has a plug for connection with the cable via a quick-action coupling. This housing portion is also provided for grabbing and maneuvering the pendant switch assembly.

A problem of conventional pendant switch assemblies resides in the fact that the operator is greatly restricted by the length of the connecting cable in his/her freedom of movement relative to the hoist.

It would therefore be desirable and advantageous to provide an improved pendant switch assembly to obviate prior art shortcomings.

SUMMARY OF THE INVENTION

According to one aspect of the present invention, a pendant switch assembly for controlling a hoist, includes a housing, a transmitter mounted to the housing for wireless transmission of control signals to a receiver mounted remotely with respect to the housing and operatively connected to a power controller of a drive of the hoist, a plurality of control elements arranged in the housing, a plurality of actuators operatively connected to the control elements in one-to-one correspondence and acted upon from outside to operate the control elements for delivering control signals for the power controller, a traction member secured to the hoist and guided downwards, a receptacle secured to a lower end of the traction member, with the housing and the receptacle having complementary locking elements so that the housing can be securely pushed into the receptacle for attachment, and pulled out again for detachment, and a power source for supplying electric energy to the control elements and the transmitter.

The present invention resolves prior art problems by configuring the housing and the receptacle in such a manner that the housing can be plugged into the receptacle for attachment, and withdrawn again for detachment, and by providing a wireless transmission of control signals through provision of a transmitter, fitted within and/or mounted at the housing, and a receiver situated at a location remote to the housing, whereby the power supply for the control elements and the transmitter is accommodated in the housing. As a consequence of the wireless transmission of the control signals and the detachable securement between the housing and the receptacle, the pendant switch assembly can easily be separated from the receptacle so that the operator is able to control the hoist irrespective of the length of the traction member.

According to another feature of the present invention, a handle is mounted to the receptacle, for maneuvering the hoist in a direction transversely to a lifting direction. Of course, the receptacle itself may be configured as handle.

According to another feature of the present invention, the receptacle and the housing may have as complementary locking elements cooperating protrusions and indentations. For example, the housing may have indentations for engagement by complementary protrusions on the receptacle, or the housing may have protrusions for engagement in complementary indentations of the receptacle.

BRIEF DESCRIPTION OF THE DRAWING

Other features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
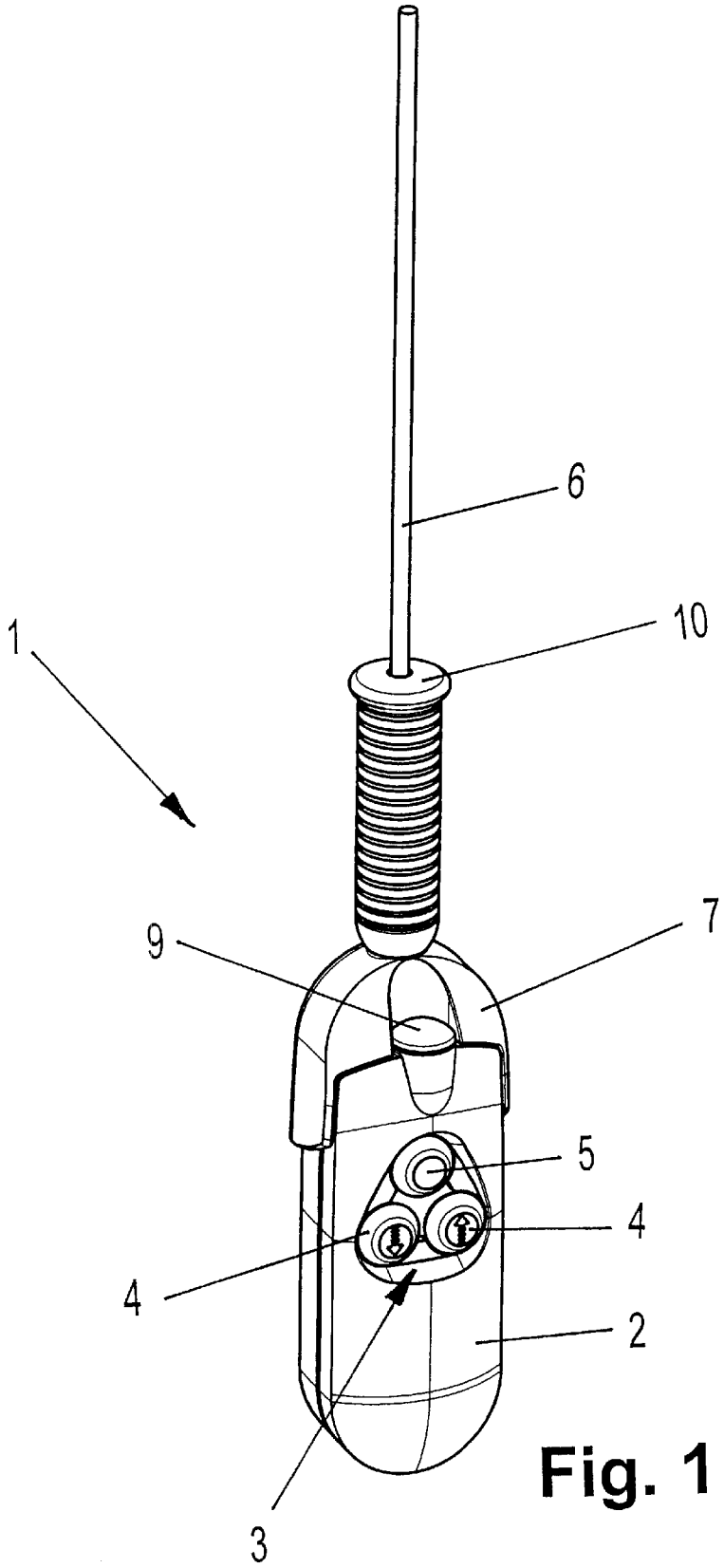
FIG. 1 is a schematic perspective front and side illustration of a pendant switch assembly according to the present invention.

Throughout all the Figures, same or corresponding elements are generally indicated by same reference numerals.

Turning now to the drawing, and in particular to FIG. 1, there is shown a schematic illustration of a pendant switch assembly according to the present invention, generally designated by reference numeral 1 for remote-controlled operation of a movable hoist (not shown) for raising and lowering a load. The pendant switch assembly 1 includes an elongate housing 2 having a keyboard, generally designated by reference numeral 3 and including control elements which are operated from outside by an operator by means of buttons 4, 5. As shown by way of example in FIG. 1 and indicated by arrows, one of the buttons 4 is designated for the operation "raising", and the other one of the buttons 4 is designated for the operation "lowering", whereas the button 5 may be used for shutdown. When actuating any one of the buttons 4, 5, the pertaining control element 3 delivers electric control signals for a power controller of the hoist drive (not shown), which may be a traveling gear or also a lifting gear.

Figure 2:
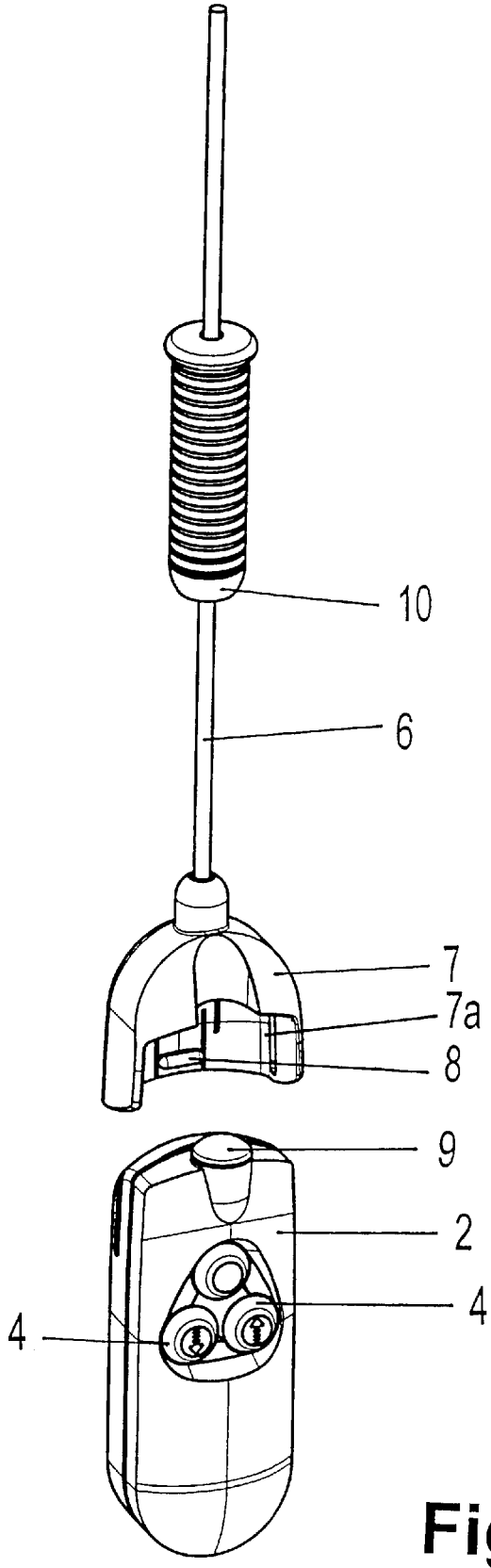
FIG. 2 is a schematic perspective front and side illustration of the pendant switch assembly, with the housing being detached.
Figure 3:
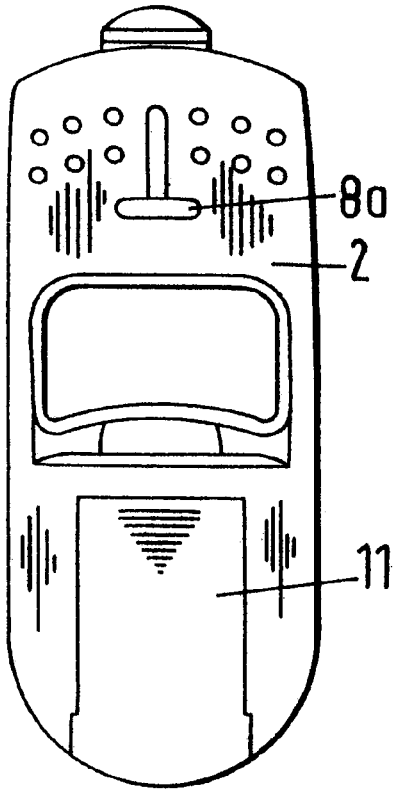
FIG. 3 is a rear view of the housing of the pendant switch assembly.

Attached to the frame of the overhead hoist is a traction member 6 of low flexural strength, e.g. a cable or rope, which is guided downwards and carries at its lower end a receptacle 7. As shown in FIG. 2, the receptacle 7 is provided in the form of an injection-molded shell that is configured with an opening 7*a* facing downwards. The opening 7*a* of the receptacle 7 is shaped to complement an upper portion of the elongate housing 2, with the receptacle 7 having a protrusion 8 for engagement in a complementary indention 8*a* in the housing 2, as shown in FIGS. 2 and 3. Of course, this configuration is shown by way of example only, and other configurations which generally follow the concepts outlined here are considered to be covered by this disclosure.

Upon attachment, the housing 2 is plugged or pushed into the receptacle 7, whereas detachment of the housing 2 requires only to pull out the housing 2 by overcoming a yielding resistance of the protrusion 8 due to its compliant nature.

Although not shown in detail in the drawing, the housing 2 accommodates an infrared transmitter for wireless transmission of the control signals for the power controller to a respective infrared receiver, not shown, by transmitting a beam of infrared light through a window 9 in a top area of the housing 2. As structure and operation of a transmitter and a receiver are generally known to a person skilled in the art, a detailed illustration in the drawing has been omitted for the sake of simplicity, and the transmitter is indicated in FIGS. 1 and 2 only by way of the exit window 9. The receiver may, for example, be arranged directly at the power controller and operatively connected thereto. Further fitted in a suitable compartment of the housing 2 is a power source for the control elements 3 and the transmitter, whereby the compartment is accessible by removing a detachable lid 11 in the back of the housing 2, as shown in FIG. 3. The power source may be an accumulator, a battery pack or a combination of accumulator and battery and has also been omitted from the foregoing drawing for sake of simplicity.

FIGS. 1 and 2 show further the provision of a handle 10 which is configured as a hollow cylinder and made of plastic material. The traction member 6 is so guided through the handle 10 that the handle 10 can be longitudinally shifted along the traction member 6. By grasping the handle 10 and in conjunction with the traction member 6, an operator can maneuver the hoist in a direction transversely to the lifting direction by pulling the handle 10. This is oftentimes desired. Hereby, the bottom end of the handle 10 is supported upon the confronting upper end face of the receptacle 7, as shown in FIG. 2. Of course, it is certainly possible to configure the receptacle 7 itself as a handle for maneuvering the hoist.

While the invention has been illustrated and described as embodied in a pendant switch assembly for controlling a movable hoist, it is not intended to be limited to the details shown since various modifications and structural changes may be made without departing in any way from the spirit of the present invention.

What is claimed as new and desired to be protected by Letters Patent is set forth in the appended claims:

1. A pendant switch assembly for controlling a hoist for raising and lowering a load, said pendant switch assembly comprising:

a housing;

a transmitter mounted to the housing for wireless transmission of control signals to a receiver mounted remotely with respect to the housing and operatively connected to a power controller of a drive of the hoist;

a plurality of control elements arranged in the housing;

a plurality of actuators operatively connected to the control elements in one-to-one correspondence and acted upon from outside to operate the control elements for delivering the control signals for the power controller to the transmitter;

a traction member secured to the hoist and guided downwards;

a receptacle secured to a lower end of the traction member, said receptacle and said housing having complementary means so that the housing can be pushed securely into the receptacle for attachment, and pulled out again for detachment; and a power source for supplying electric energy to the control elements and the transmitter.

2. The pendant switch assembly of claim 1, and further comprising a handle, mounted to the receptacle, for maneuvering the hoist in a direction transversely to a lifting direction.

3. The pendant switch assembly of claim 2, wherein the handle is configured as hollow cylinder, said traction member being guided through the handle so as to allow a displacement of the handle along the traction member.

4. The pendant switch assembly of claim 2, wherein the handle has one end face supported during maneuvering of the hoist upon a confronting end face of the receptacle.

5. The pendant switch assembly of claim 1, wherein the receptacle is configured as a downwardly open shell.

6. The pendant switch assembly of claim 1, wherein the receptacle is configured as handle for maneuvering the hoist by an operator.

7. The pendant switch assembly of claim 1, wherein the receptacle and the housing have complementary locking elements to effect a detachable connection therebetween, with the locking elements selected from the group consisting of indentation and protrusion.

8. The pendant switch assembly of claim 7, wherein the housing has an indentation for engagement by a protrusion of the receptacle.

9. The pendant switch assembly of claim 7, wherein the housing has a protrusion for engagement in an indentation of the receptacle.

10. The pendant switch assembly of claim 1, wherein the traction member is a cable of low flexural strength.

* * * * *